US009047806B2

(12) United States Patent
Lim et al.

(10) Patent No.: US 9,047,806 B2
(45) Date of Patent: Jun. 2, 2015

(54) DISPLAY DEVICE AND METHOD OF ADJUSTING VIEWING ANGLE THEREOF

(75) Inventors: Dong-Hyun Lim, Gyeonggi-do (KR); Woo-Sik Jung, Gyeonggi-do (KR); Dong-Hyun Ham, Gyeonggi-do (KR); Seong-Hwan Kim, Gyeonggi-do (KR)

(73) Assignee: LG Electronics Inc., Seoul (KR)

( * ) Notice: Subject to any disclaimer, the term of this patent is extended or adjusted under 35 U.S.C. 154(b) by 738 days.

(21) Appl. No.: 12/758,052

(22) Filed: Apr. 12, 2010

(65) Prior Publication Data

US 2010/0295827 A1 Nov. 25, 2010

(30) Foreign Application Priority Data

May 25, 2009 (KR) ..... 10-2009-0045669
May 25, 2009 (KR) ..... 10-2009-0045670
May 25, 2009 (KR) ..... 10-2009-0045671

(51) Int. Cl.
*G09G 3/20* (2006.01)

(52) U.S. Cl.
CPC ..... *G09G 3/20* (2013.01); *G09G 2320/068* (2013.01)

(58) Field of Classification Search
CPC ..... G09G 2320/068
USPC ..... 345/32, 84, 103, 204
See application file for complete search history.

(56) References Cited

U.S. PATENT DOCUMENTS

2005/0215291 A1* 9/2005 McDonald ..... 455/566
2005/0286000 A1* 12/2005 Tsai et al. ..... 349/119
2006/0170644 A1* 8/2006 Ioki et al. ..... 345/102
2007/0171193 A1* 7/2007 Nakamura ..... 345/156
2009/0040297 A1* 2/2009 Harada et al. ..... 348/54
2009/0167737 A1* 7/2009 Chen et al. ..... 345/207
2009/0213147 A1* 8/2009 Sagardoyburu et al. ..... 345/690

FOREIGN PATENT DOCUMENTS

JP 2007-226306 A 9/2007
JP 2007-322549 A 12/2007
KR 1020080050894 * 6/2008
KR 10-2009-0047039 A 5/2009

OTHER PUBLICATIONS

Korean Office Action issued in Application No. 10-2009-0045671 on Feb. 27, 2015, 4 pages.

* cited by examiner

*Primary Examiner* — Allison Johnson
(74) *Attorney, Agent, or Firm* — Fish & Richardson P.C.

(57) ABSTRACT

A display device for selectively adjusting a viewing angle thereof and a method of adjusting a viewing angle thereof are provided. The display device comprises: a display unit displaying an input image based on a determined viewing angle; and a controlling unit determining a viewing angle of the display unit according to a predetermined viewing condition and controlling to display the input image with the determined viewing angle, wherein the viewing condition is one of a viewer position condition, an image type condition, and a viewer setting condition.

11 Claims, 7 Drawing Sheets

DISPLAY DEVICE AND METHOD OF ADJUSTING VIEWING ANGLE THEREOF

CROSS-REFERENCE TO RELATED APPLICATIONS

The present application claims priority under 35 U.S.C. 119 and 35 U.S.C. 365 to Korean Patent Application Nos. 10-2009-0045669, 10-2009-0045670 and 10-2009-0045671 (filed on 25 May, 2009), which are hereby incorporated by reference in their entirety.

BACKGROUND

The present disclosure relates to a display device, and more particularly, to a display device for selectively adjusting a viewing angle thereof according to various viewing environments and a method of adjusting a viewing angle thereof.

A display device includes a monitor. The monitor may be used for a display terminal of a computer device and also used for a display device of an image device such as a television and a video recorder and player.

A related art monitor typically includes a cathode ray tube (CRT) display device, but due to its bulky volume, high power consumption, and a heavy weight, a thin film type display device is increasingly used as the latest technology image display device.

A liquid crystal display (LCD) or a plasma display panel (PDP) is used for the thin film type display device.

In relation to basic principles of the above LCD, liquid crystal is disposed between two thin glass substrates to which a transparent conductive layer is attached and an electric filed is applied to the transparent conductive layer through a matrix electrode. Then, the LCD uses a light scattering phenomenon in a liquid crystal layer according to a change of the electric field and displays images to a user by projecting a reflected light or a transmitted light on the liquid crystal layer.

In addition, a general display device cannot adjust an arbitrary viewing angle. Accordingly, according an angle that a viewer watches a display device, others may easily peep at screen contents being displayed on the display device.

Moreover, since various personal multimedia services are gradually more used through the latest satellite reception technology, a viewer should be aware of others during a personal multimedia service due to a wide viewing angle of a display device.

On the contrary, if a viewing angle of a display device is narrow, although many people want to use the same multimedia service through one display device, it is impossible due to its narrow viewing angle.

Accordingly, required is a method of selectively adjusting a viewing angle of a display device according to viewing environments.

SUMMARY

Embodiments provide a display device for protecting view's privacy by adjusting a viewing angle thereof according to various viewing environments and a method of adjusting a viewing angle thereof.

Embodiments also provide a display device capable of automatically adjusting a viewing angle thereof according to a viewer position and a method of adjusting a viewing angle thereof.

Embodiments also provide a display device capable of automatically adjusting a viewing angle thereof according to a type of contents that a viewer watches and a method of adjusting a viewing angle thereof.

Embodiments also provide a display device capable of separately adjusting a left viewing angle and a right viewing angle thereof and a method of adjusting a viewing angle thereof.

In one embodiment, a display device comprises: a display unit displaying an input image based on a determined viewing angle; and a controlling unit determining a viewing angle of the display unit according to a predetermined viewing condition and controlling to display the input image with the determined viewing angle, wherein the viewing condition is one of a viewer position condition, an image type condition, and a viewer setting condition.

In another embodiment, a method of adjusting a viewing angle of a display device, the method comprising: detecting a position of a viewer; determining a viewing angle of a display screen where an input image is displayed according to the position of the detected viewer; and displaying the input image with the determined viewing angle.

In further another embodiment, a method of adjusting a viewing angle of a display device, the method comprising: inputting an image signal; determining a type of the inputted image signal; determining a viewing angle of a display screen where the image signal is displayed, based on the type of the determined image signal; and displaying the inputted image signal based on the determined viewing angle.

In still further another embodiment, a method of adjusting a viewing angle of a display device, the method comprising: displaying a viewing angle setting screen; setting a viewing angle of an image displayed through a display screen in the displayed viewing angle setting screen; and displaying the image based on the set viewing angle.

The details of one or more embodiments are set forth in the accompanying drawings and the description below. Other features will be apparent from the description and drawings, and from the claims.

DETAILED DESCRIPTION OF THE EMBODIMENTS

Preferred embodiments will be described.

In embodiments, terms that will be used are currently extensive general terms in use, but may be arbitrarily selected terms in a specific case. In that case, their meanings are specifically described in the detailed description of the embodiments below. Thus, the embodiments should be understood with the meaning of the terms not the simple naming of the terms.

That is, during description below, a term 'include' does not exclude components or operations different from listed components or operations.

Figure 1:
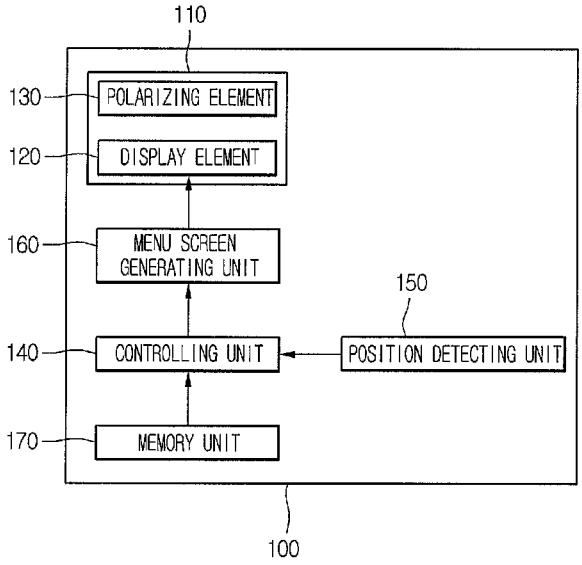
FIG. 1 is a view illustrating a configuration of a display device according to an embodiment.

FIG. 1 is a view illustrating a configuration of a display device according to an embodiment.

Referring to FIG. 1, the display device 100 includes a display unit 110, a controlling unit 140, a position detecting unit 150, a menu screen generating unit 160, and a memory unit 170. The display unit 110 may includes a display element 120 and a polarizing element 120.

The display unit 110 displays an image signal provided from an external according to a viewing angle determined by the controlling unit 140 that will be described later.

Here, the display unit 110 includes the display element 120 where an actual image is displayed and the polarizing element 120 that is attached to one side of the display element 120 and performs a polarizing function optically according to an electric control signal provided from the controlling unit 140.

Figure 2:
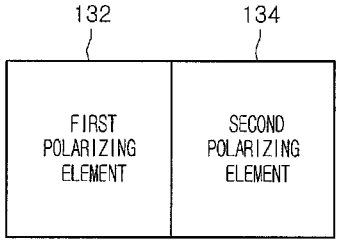
FIG. 2 is a detailed view of a polarizing element of FIG. 1.

FIG. 2 is a detailed view of the polarizing element 120 of FIG. 1.

Referring to FIG. 2, the polarizing element 120 includes a first polarizing element 132 and a second polarizing element 134. Here, the first polarizing element 132 is attached to the left region and the second polarizing element 134 is attached to the right region, based on the middle of the display element 120.

In the embodiment, the polarizing element 132 includes two polarizing elements, but this is just one example. It is apparent that the number of polarizing elements 132 varies according to the segmented region of the display screen.

The controlling unit 140 provides an electric control signal to the polarizing element 120 and adjusts a polarization degree based on a viewing angle determined by a predetermined viewing condition.

Here, the controlling unit 140 predetermines a polarization degree (for example, a narrow viewing angle or a wide viewing angle), and then adjusts a polarization degree of the polarizing element 120 through a switching method for simply turning on/off an electric control signal. For example, when the controlling unit 140 turns on a switch, a polarization degree of the polarizing element 120 may be adjusted to a wide viewing angle. On the contrary, when the controlling unit 140 turns off a switch, a polarization degree of the polarizing element 120 may be adjusted to a narrow viewing angle.

That is, if it is assumed that there is a mobile communication terminal with a mounted display device of an adjustable viewing angle, when a viewer presses a predetermined button to adjust a viewing angle, the controlling unit 140 provides an electric control signal corresponding to on-switching to the polarizing element 120 according to a designated algorithm. Then, the polarizing element 120 performs a polarizing function optically and transmits a light having directivity according to an electric control signal provided through the controlling unit 140.

Accordingly, a viewing angle of the display unit 110 becomes narrow and thereby, an image displayed through the display unit 110 is provided to only viewers who watch the display unit 110 in the front.

On the contrary, if an electric control signal corresponding to off-switching is provided through the controlling unit 140, the polarizing element 120 does not perform a polarizing function and thereby, an image displayed through the display unit 110 is provided with a viewing angle degree set through a basic property of the display unit 110. Of course, it is apparent that the on/off function may be interchangeable.

However, the controlling unit 140 is allowed to adjust a polarization degree of the polarizing element 120 by a predetermined angle, like adjusting the brightness of the display element 120, because an electric control signal applied to the polarizing element 120 may be minutely adjusted.

That is, in this embodiment, the controlling unit 140 provides the above-mentioned predetermined viewing angle (on switching on, off switching) and also minutely adjusts an intensity of an electric control signal applied to the polarizing element 120, such that a viewing angle of the display unit 110 is adjusted within the maximum and minimum viewing angle range.

Here, the maximum and minimum viewing angle range is as follows.

The maximum viewing angle is determined by a basic property of the display element 120. That is, the maximum viewing angle is not a specific value that is identically applied to all display devices but is determined by a condition applied when the display element 120 is manufactured.

Additionally, the minimum viewing angle is 0 degree. That is, if the set viewing angle is 0 degree, the controlling unit 140 provides an electric control signal corresponding to the set viewing angle to the polarizing element 120. Then, the polarizing element 120 blocks all lights based on the electric control signal of the controlling unit 140.

Here, as mentioned above, the polarizing element 120 includes the first polarizing element 132 for adjusting a viewing angle of the left screen and the second polarizing element 134 for adjusting a viewing angle of the right screen.

In addition, the polarizing element 120 may be separately set on the top surface of the display element 120 or may be set being inserted and integrated into the inside of the display element 120. The configuration of the polarizing element 120 may vary according to determination of display device manufacturers and may be controlled by an algorithm described below.

The controlling unit 140 determines a viewing angle of the display unit 110 according to a predetermined viewing condition, provides an electric control signal corresponding to the determined viewing angle to the polarizing element 120, and adjusts a viewing angle of an image being displayed through a display screen.

The viewing condition may include a viewer position condition, an image type condition, and a viewer setting condition. The viewer position condition is for determining a viewing angle of the display unit 110 according to a position of a viewer who watches the display unit 110. The image type condition is for determining a viewing angle of the display unit 110 according to a type of an image displayed through the display unit 110. The viewer setting condition is for determining a viewing angle of the display unit 110 according to a viewing angle set by a viewer through a viewing angle setting screen.

Hereinafter, a view angle determining operation of the display unit 110 according to each viewing condition will be described in more detail.

The viewing condition of a first embodiment is a viewer position condition and the controlling unit 140 determines a viewing angle of the display unit 110 according to a position of a viewer who watches the display unit 110.

For this, the position detecting unit 150 is included in the display device 100 according to the first embodiment.

The position detecting unit 150 detects a position of a viewer to determine a viewing angle of the display unit 110.

Here, the position detecting unit 150 may be realized with an infrared sensor and an image capturing unit. However, the position detecting unit 150 may include an image capturing unit for detecting a position of the viewer.

The position detecting unit 150 is disposed at one side of the display device 100 and captures an image about a front region of the display unit 110. Here, the position detecting unit 150 is disposed at the middle of the display unit 110 and may capture a front image for detecting a position of the viewer. That is, the position detecting unit 150 is an image capturing device and may include a web cam.

The position detecting unit 150 captures an image about a front region of the display unit 110 and analyzes the captured image to detect a position of the viewer in the image. Then, the position detecting unit 150 confirms viewer position outermost information based on the detected viewer position.

A method of confirming the outermost information of the position detecting unit 150 will be described in more detail.

Figure 3:
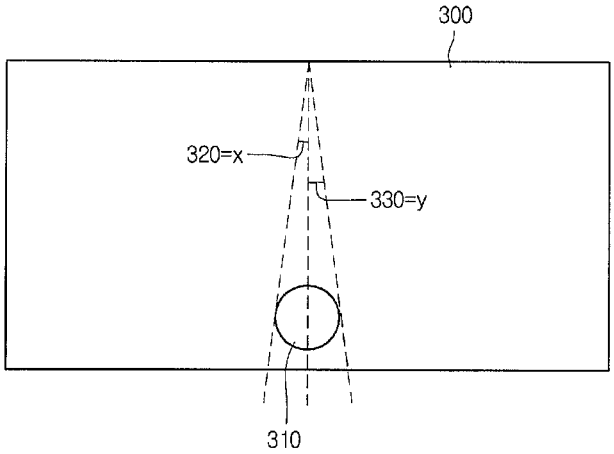
FIG. 3 is a view illustrating an outermost information confirming method according to a first embodiment.
Figure 4:
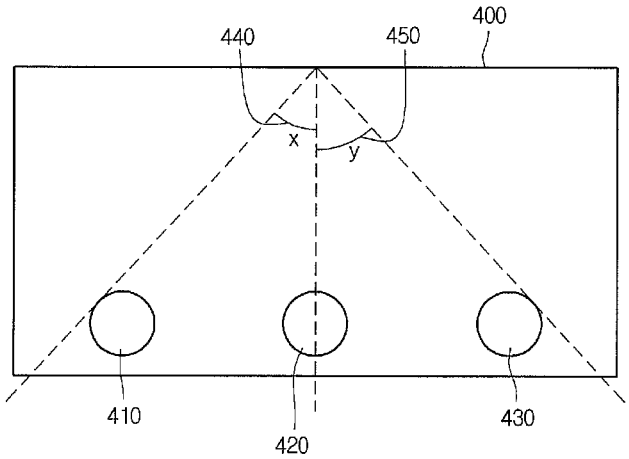
FIG. 4 is a view illustrating an outermost information confirming method according to a second embodiment.

FIG. 3 is a view illustrating an outermost information confirming method according to a first embodiment. FIG. 4 is a view illustrating an outermost information confirming method according to a second embodiment.

Referring to FIG. 3, the position detecting unit 150 captures an image about a front region. Then, once the image is captured, the position detecting unit 150 divides the captured image 300. Here, a reference for dividing the captured image 300 is determined by a configuration of the polarizing element 120.

That is, the polarizing element 120 is set for each of the left region and the right region based on the middle of the display element 120, such that the captured image 300 is divided into a left image and a right image based on the middle. Here, the divided left image is used for determining a viewing angle of the first polarizing element 132 and the divided right image is used for determining a viewing angle of the second polarizing element 134.

If the captured image 300 is divided as above, the position detecting unit 150 analyzes each of the divided left and right images, so as to detect a position of a viewer. For example, if a viewer is included in the captured image, since a region where the viewer is captured has a specific brightness level, a position of the viewer in the captured image is detected by analyzing a brightness level of the captured image.

If the position of the viewer is detected, the position detecting unit 150 confirms outermost information for determining a viewing angle based on the position of the detected viewer. Here, the outermost information is divided into left outermost information about the left image and right outermost information about the right image.

That is, as shown in FIG. 3, if a position 310 of a viewer is detected in the captured image 300, the position detecting unit 150 confirms the outermost information 320 and x about the left image and outermost information 330 and y about the right image based on the position 310 of the detected viewer.

As mentioned above, the position detecting unit 150 provides the confirmed outermost information to the controlling unit 140 and the controlling unit 140 determines the viewing angle by using the provided outermost information. That is, the controlling unit 140 uses the outermost information for the left image to determine a polarization degree of the first polarizing element 132 and uses the outermost information about the right image to determine a polarization degree of the second polarizing element 134. Substantially, the x degree is a left viewing angle according to the polarization degree of the first polarizing element 132 and the y degree is a right viewing angle according to a polarization degree of the second polarizing element 132.

Here, a viewer who watches the current display device 100 may be in plurality.

That is, referring to FIG. 4, if there are a first viewer 410, a second viewer 420, and a third viewer 430 in a captured image 400, the position detecting unit 150 detects a viewer position based on a viewer at the leftmost and a viewer at the rightmost among the first to third viewers 410 to 430.

That is, since the viewer at the leftmost is the first viewer 410, the position detecting unit 150 confirms left outermost information 440 and x based on a position of the first viewer 410. That is, since the viewer at the rightmost is the third viewer 430, the position detecting unit 150 confirms right outermost information 450 and y based on a position of the third viewer 430. The controlling unit 140 uses the outermost information to adjust a polarization degree of the first and second polarizing elements 132 and 134.

In addition, if there is no viewer in the divided left or right image, an image may not be provided to the left or right of the display unit 110 by adjusting a polarization degree of the first polarizing element 132 or the second polarizing element 134.

A viewing condition of the second embodiment is an image type condition and the controlling unit 140 determines a viewing angle of the display unit 110 according to a type of an image displayed through the display unit 110.

For this, the display device 100 includes the menu screen generating unit 160 and the memory unit 170 according to the second embodiment.

The menu screen generating unit 160 generates a menu screen for setting a viewing angle according to each type of an input image signal. The generated menu screen is outputted through the display element 120. Then, a viewer sets a viewing angle corresponding to each type of an input image in the menu screen outputted through the display element 120. At this point, when the menu screen is displayed, if a predetermined viewing angle is a narrow viewing angle, the viewing angle may be adjusted to a wide viewing angle while the menu screen is displayed.

Figure 5:
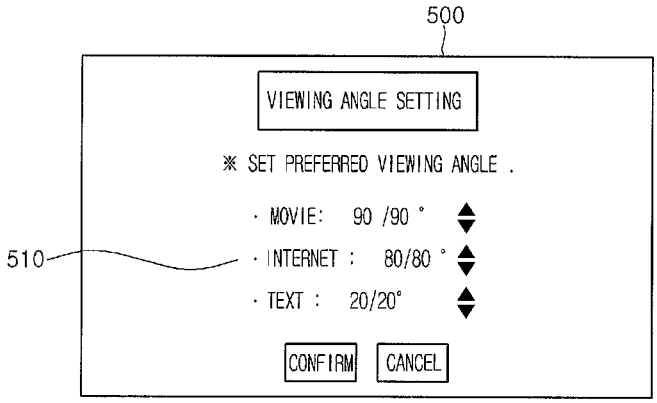
FIG. 5 is a view illustrating one example of a viewing angle setting screen according to an embodiment.

FIG. 5 is a view illustrating one example of a viewing angle setting screen according to an embodiment.

Referring to FIG. 5, the viewing angle setting screen 500 includes a viewing angle setting region 510 for setting a viewing angle corresponding to each type of an input image. Then, a viewer uses the viewing angle setting region 510 to set a viewing angle corresponding to each input image. At this point, the viewing angle setting region 510 includes a left viewing angle setting region for setting a left viewing angle and a right viewing angle setting region for setting a right viewing angle according to types of an input image.

The memory unit 170 is a storage unit for storing various data and may be set with an Electrically Erasable and Programmable Read Only Memory (EEPROM).

In addition, a driving program necessary for adjusting a viewing angle of the display unit 110 and viewing angle information related to types of an input image set by a user are stored in the memory unit 170.

Here, the image may a broadcast program inputted through an antenna and a cable connector, an external device signal inputted through an external interface unit, or a personal computer (PC) signal inputted through a PC.

In addition, if a viewer does not set a viewing angle separately, a default value is applied to adjust a viewing angle.

That is, an image such as a movie or internet screen does not require special security generally, such that the viewing angle is set with the maximum viewing angle. However, an image such as a secrete text screen requires security because personal word processing is in progress. Accordingly, the image signal such a movie or internet screen allows viewers to watch the screen at the side and front by applying the maximum viewing angle, and the image such as a text screen allows only a specific viewer who performs personal word processing to watch the screen only at the front by applying the minimum viewing angle (not 0 degree).

Once an image is inputted, the controlling unit 140 recognizes types of the inputted image and extracts viewing angle information corresponding to the recognized type from the memory unit 170. Then, the controlling unit 140 uses the extracted viewing angle information to adjust a viewing angle of the display unit 110.

In addition, if the viewing angle information corresponding to a type of the inputted image is not stored in the memory unit 170, the controlling unit 140 controls to display a menu screen for setting a viewing angle corresponding to a type of the image.

Figure 6:
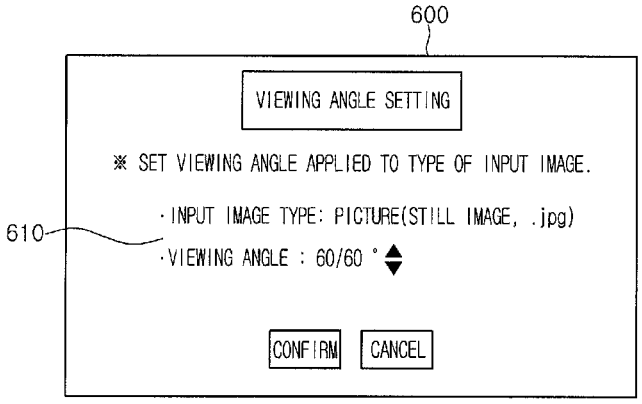
FIG. 6 is a view illustrating another example of a viewing angle setting screen according to an embodiment.

FIG. 6 is a view illustrating another example of a viewing angle setting screen according to an embodiment.

Referring to FIG. 6, the viewing angle setting screen 600 displays information corresponding to a type of the input image and includes a viewing angle setting region 610 for setting a viewing angle corresponding to a type of the input image.

Moreover, the controlling unit 140 stores the set image type information and viewing angle information in the memory unit 170 through the viewing angle setting screen 600 and applies the set viewing angle to adjust a viewing angle of the display unit 110.

Moreover, there may be a plurality of images displayed on the display element 120.

Accordingly, when a plurality of images are displayed on the display unit 110 (that is, a plurality of image signals are inputted from an external), the controlling unit 140 adjusts a viewing angle of the display unit 110 by using viewing angle information corresponding to a type of currently activated image.

Moreover, when a plurality of images are displayed in a picture out picture (POP) form through the display element 120, the controlling unit 140 adjusts a left viewing angle of the display unit 110 by using viewing angle information corresponding to a type of an image displayed at the left region and adjusts a right viewing angle of the display unit 110 by using viewing angle information corresponding to a type of an image displayed at the right region.

That is, the controlling unit 140 extracts viewing angle information corresponding to a type of an image displayed at the left region, from the memory unit 170. Then, the controlling unit 140 uses the extracted viewing angle information to adjust a polarization degree of the first polarizing element 132. In addition, the controlling unit 140 extracts viewing angle information corresponding to a type of an image displayed at the right region, from the memory unit 170. Then, the controlling unit 140 uses the extracted viewing angle information to adjust a polarization degree of the second polarizing element 134.

In the display device according to the second embodiment, if important personal data or secrete items need to be displayed, a display screen image is outputted at a front angle such that security about user information can be maintained and personal word processing can be effectively performed.

A viewing condition of a third embodiment is a viewer setting condition and the controlling unit 140 uses a viewing angle set by a viewer to adjust a viewing angle of the display unit 110.

For this, the menu screen generating unit 160 is included in the display device 100 according to the third embodiment.

The controlling unit 140 of the third embodiment controls the menu screen generating unit 160 to generate a viewing angle setting screen and controls the display element 120 to display the generated viewing angle setting screen. At this point, the viewing angle setting screen may be displayed by a viewer command, or may be displayed only if specific conditions are satisfied. For example, the viewing angle setting screen may be displayed when a power-on condition, an input mode switching condition, of a channel switching condition occurs.

Figure 7:
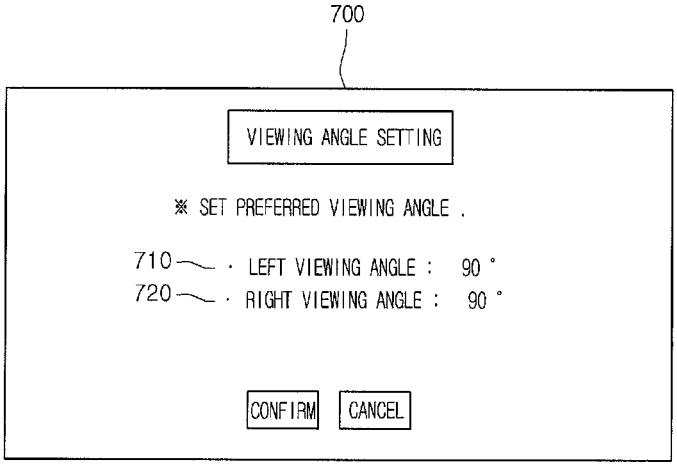
FIG. 7 is a view illustrating another example of a viewing angle setting screen according to an embodiment.

FIG. 7 is a view illustrating another example of a viewing angle setting screen according to an embodiment.

As shown in FIG. 7, the viewing angle setting screen 700 includes a first viewing angle setting region 710 for setting a left viewing angle and a second viewing angle setting region 720 for setting a right viewing angle. In addition, viewing angle information, which is currently set within an adjustable range, is displayed in the first viewing angle setting region 710 and the second viewing angle setting region 720. Moreover, a viewer uses up and down direction keys to increase or decrease the displayed viewing angle information such that a viewing angle that the viewer himself or herself wants can be set.

That is, the displayed viewing angle setting screen 700 provides a menu screen through which a viewer can separately set the left viewing angle and the right viewing angle.

The controlling unit 140 uses a viewing angle set through the first viewing angle setting region 710 to adjust a polarization degree of the first polarizing element 132. In addition, the controlling unit 140 uses a viewing angle set through the second viewing angle setting region 720 to adjust a polarization degree of the second polarizing element 134.

Figure 8:
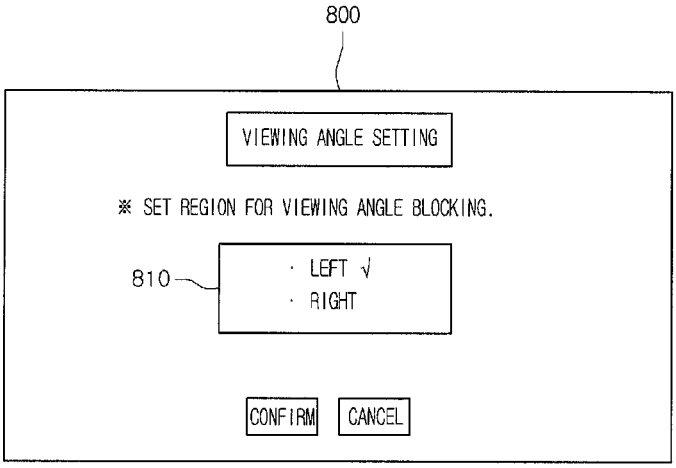
FIG. 8 is a view illustrating a viewing angle setting screen according to an embodiment.

FIG. 8 is a view illustrating a viewing angle setting screen according to an embodiment.

As shown in FIG. 8, the viewing angle setting screen 800 includes an output blocking setting region 810 to set a region that a viewer wants to block an image output among the left and right regions. That is, once a display device is installed, when a first viewer is positioned at the left of the display device and a second viewer is positioned at the right of the display device, if the second viewer does not want to watch the display device anymore, the first viewer may set to block a viewing angle about the right region in the viewing angle setting screen 800.

The controlling unit 140 sets a viewing angle of the side (where the viewing angle blocking is set) with the minimum viewing angle and a viewing angle of the other side with the maximum viewing angle. For example, if output blocking about the left region is set in the viewing angle setting screen 800, the controlling unit 140 sets the left viewing angle of the display unit 110 with the minimum viewing angle (for example, 0 degree) and sets the right viewing angle of the display unit 110 with the maximum viewing angle.

Figure 9:
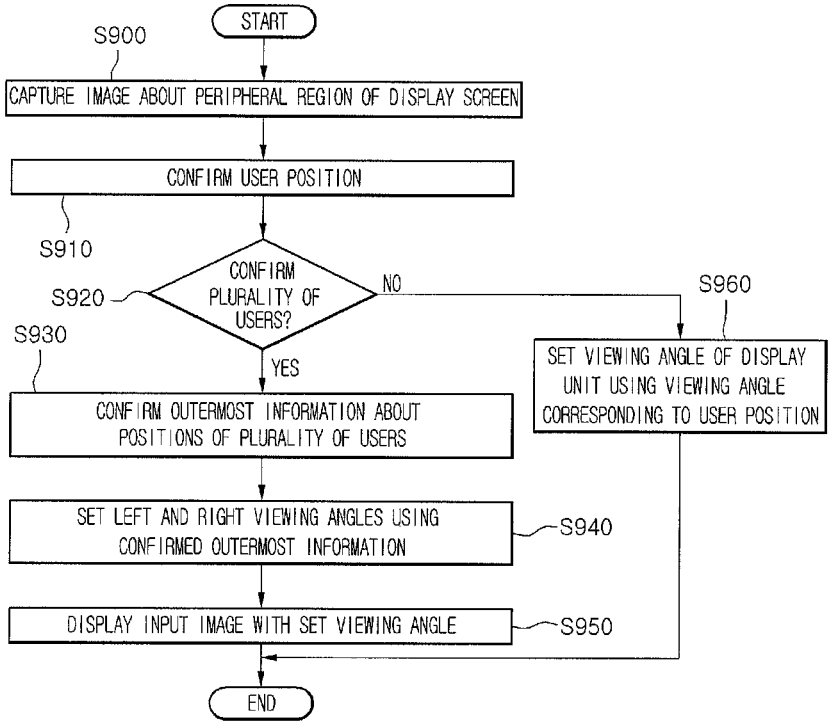
FIG. 9 is a flowchart illustrating a method of adjusting a viewing angle of a display device step by step according to a first embodiment.

FIG. 9 is a flowchart illustrating a method of adjusting a viewing angle of a display device step by step according to a first embodiment.

Referring to FIG. 9, an image about a peripheral region of a display screen is captured first in operation S900. That is, the position detecting unit 150 is a webcam equipped in a display device. The webcam captures a peripheral image of an installation region to detect a viewer position and delivers the detected viewer position to the controlling unit 140.

That is, the position detecting unit 150 captures a viewer to adjust a viewing angle of the display unit 110. Accordingly, an image inputted from a microlens mounted on the position detecting unit 150 is converted into optical signal and an image signal sequentially to generate image data using the captured image.

Then, the position detecting unit 150 confirms a viewer position by using the captured image in operation S910. Here, the user position recognizing method analyzes a brightness level of the captured image by each pixel and recognizes a user capturing position from the captured image based on the analyzed brightness level. Additionally, a user face image is captured and stored in advance and the stored user face image is compared to the captured image to recognize a position where an actual user face is captured. The above method of recognizing a user position by using the captured image is apparent to those skilled in the art and thus its detailed description will be omitted.

In addition, during the recognizing of the user position, an entire body of a user is not recognized but a specific face portion of the user may be recognized. That is, in general, a viewing angle of the display unit 110 should be determined by a position of an eye of a user not by a position of a user. That is, even if a user stays at the same position, there may be a difference in an image provided to the user based on where an eye of a user is positioned, and accordingly, an eye position may be recognized as a user position in the captured image. In addition, besides the user face, various other portions such as an eyebrow, a nose, a mouth, and an ear may be used to recognize a user position.

The controlling unit 140 determines whether a plurality of users are recognized or not in the captured image in operation S920. That is, it is determined that the number of viewers who watch a current display screen is one or more than two. This is confirmed through user position information obtained by analyzing the captured image.

If a plurality of users are recognized in the captured image, the controlling unit 140 confirms outermost information about positions of the plurality of users in operation S930. That is, as shown in FIG. 4, if the plurality of users currently watch the same display screen, it is impossible to adjust a viewing angle of the display unit 110 based on one user. Accordingly, the controlling unit 140 confirms outermost information according to a user position in the captured image and adjusts a viewing angle of the display unit 110 by using the confirmed outermost information.

Here, the outermost information includes left outermost information and right outermost information. That is, the outermost information means position information of a user positioned at the rightmost and position information of a user positioned at the leftmost. That is, as shown in FIG. 4, based on the front region, the x degree about a user positioned at the leftmost is the outermost information about the left region and the y degree about a user positioned at the rightmost is the outermost information about the right region.

The controlling unit 140 uses the outermost information to set each of the left viewing angle and the right viewing angle of the display unit 110 in operation S940. That is, the controlling unit 140 uses the x degree to set the left viewing angle of the display unit 110 and uses the y degree to set the right viewing angle of the display unit 110.

Next, the display element 120 displays an input image with a viewing angle determined by the controlling unit 140 in operation S950. That is, the controlling unit 140 outputs an electric control signal corresponding to the determined left viewing angle to the first polarizing element 132 and outputs an electric control signal corresponding to the determined right viewing angle to the second polarizing element 134. Accordingly, the polarizing element 120 equipped in the display element 120 adjusts a polarization degree by an electric control signal outputted from the controlling unit 140 such that a viewing angle about a screen displayed through the display element 120 can be adjusted.

In addition, if one user is recognized in the captured image, the controlling unit 140 sets a viewing angle of the display element 120 corresponding to a position of the recognized user in operation S960.

Figure 10:
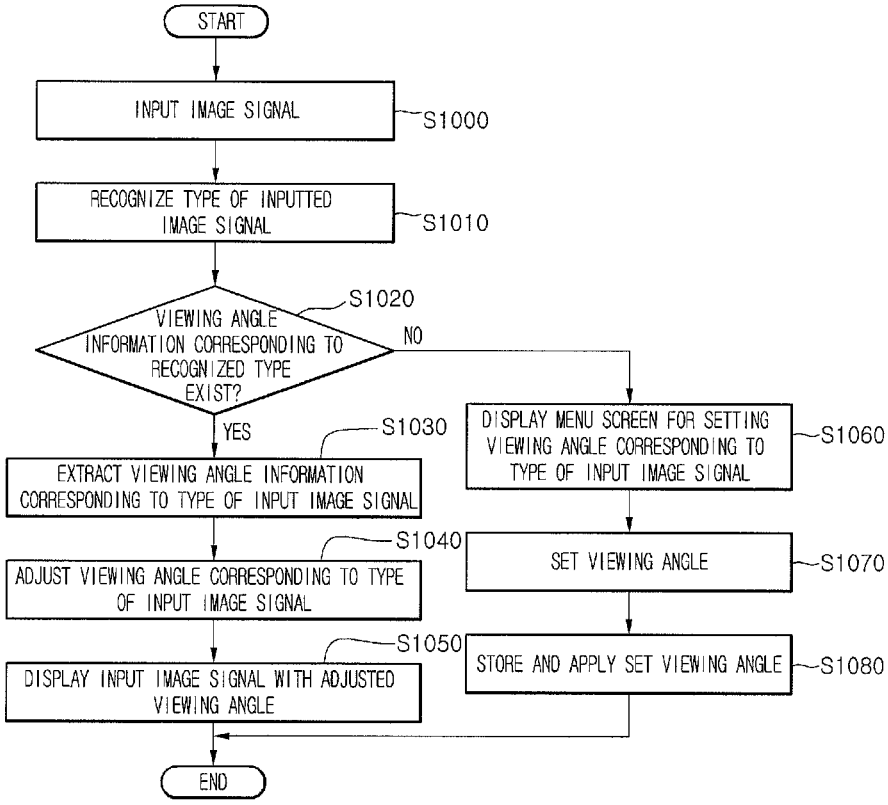
FIG. 10 is a flowchart illustrating a method of adjusting a viewing angle of a display device step by step according to a second embodiment.

FIG. 10 is a flowchart illustrating a method of adjusting a viewing angle of a display device step by step according to a second embodiment.

As shown in FIG. 10, the viewing angle adjusting method of the display device according to the second embodiment receives an image signal inputted from an external first in operation S1000. Here, the image signal may a broadcast program inputted through an antenna and a cable connector, an external device signal inputted through an external interface unit, or a personal computer (PC) signal inputted through a PC.

The controlling unit 140 determines which type an image signal is inputted operation S1010. Here, if the inputted image signal is a signal inputted from a PC, the controlling unit 140 receives information about the image signal inputted from the PC and recognizes a type of the inputted image signal by using the received information. Here, the type of the image signal may be classified by a user or may be classified by a default condition.

That is, as shown in FIG. 5, the viewing angle setting screen 500 includes a viewing angle setting region 510 for setting a viewing angle corresponding to each type of the input image signal, and a user may set a viewing angle corresponding to each type of the image signal by using the viewing angle setting region 510. In addition, a viewing angle corresponding to each type of an image signal may be set by a default value.

That is, an image signal such as a movie or internet screen does not require special security generally, such that the viewing angle is set with the maximum viewing angle. However, an image signal such as a text requires security because personal word processing is in process. Accordingly, the image signal such as a movie or internet screen allows users to watch the display at the side and front by applying the maximum viewing angle, and the image signal such as a text allows only a specific user who performs a word processing to watch the display only at the front by applying the minimum viewing angle (not 0 degree).

Once a type of the inputted image signal is recognized, the controlling unit 140 recognizes whether viewing angle information corresponding to the recognized type is already stored in the memory unit 170 in operation S1020. That is, the controlling unit 140 determines whether the viewing angle information corresponding to the type of the recognized image signal is set by a user or a default value in advance.

In addition, if the viewing angle information corresponding to the type of the inputted image signal is stored in the memory unit 170 in advance, the pre-stored viewing angle information is extracted in operation S1030.

Then, the controlling unit 140 uses the extracted viewing angle information to adjust a viewing angle of the display unit 110 in operation S1040. That is, the controlling unit 140 outputs an electric control signal corresponding to the determined left viewing angle to the first polarizing element 132 and outputs an electric control signal corresponding to the determined right viewing angle to the second polarizing element 134.

The display unit 110 displays an input image with a viewing angle adjusted by the controlling unit 140 in operation 1050. That is, the polarizing element 120 equipped in the display unit 110 adjusts a polarization degree using an electric control signal outputted from the controlling unit 140 such that a viewing angle about a screen displayed through the display element 120 can be adjusted.

In addition, if the viewing angle information corresponding to the type of the inputted image signal is not stored in the memory unit 170, the controlling unit 140 controls to display a menu screen for setting a viewing angle for the type of the image signal in operation S1060.

That is, as shown in FIG. 6, displayed is the viewing angle setting screen 600 for displaying information about a type of the inputted image and including a viewing angle setting region 610 for setting a viewing angle corresponding to a type of the inputted image.

The controlling unit 140 sets a viewing angle corresponding to the type of the inputted image signal according to a command inputted from a user in operation S1070.

Then, the controlling unit 140 stores the type information of the inputted image signal and the set viewing angle information in the memory unit 170 and applies the set viewing angle to adjust a viewing angle of the display unit 110.

Moreover, there may be a plurality of image signals displayed on the display element 120.

Accordingly, when a plurality of image signals are displayed on the display element 120 (that is, a plurality of image signals are inputted from an external), the controlling unit 140 adjusts a viewing angle of the display unit 110 by applying a viewing angle corresponding to a type of currently activated image signal.

Moreover, when a plurality of images are displayed in a picture out picture (POP) form through the display element 120, the controlling unit 140 adjusts a left viewing angle of the display unit 110 by using viewing angle information corresponding to an image signal displayed at the left region and adjusts a right viewing angle of the display unit 110 by using viewing angle information corresponding to an image signal displayed at the right region.

Moreover, if the inputted image signal is in plurality, the controlling unit 140 devices divides the display element 120 based on a display region of the image signal and determines each viewing angle that will be applied to the divided region.

Likewise, in relation to the display device according to the second embodiment, a viewing angle of a display device is arbitrarily adjusted depending on user needs such that user convenience can be improved and also a personal display screen can be protected from others. In addition, when personally important data or items that require security need to be displayed, a display screen image is outputted at a front angle such that privacy information can be maintained and word processing can be effectively performed.

Figure 11:
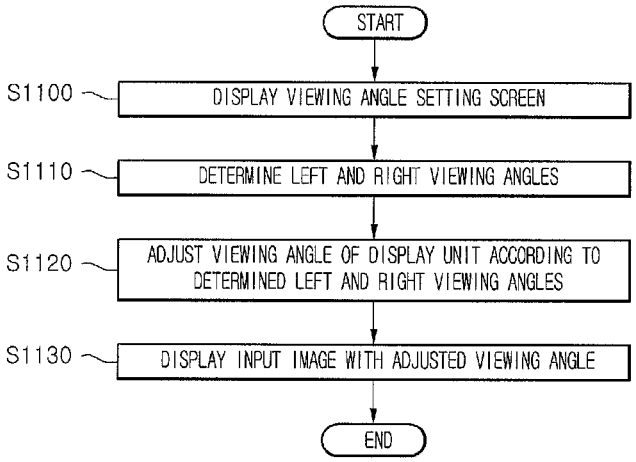
FIG. 11 is a flowchart illustrating a method of adjusting a viewing angle of a display device step by step according to a third embodiment.

FIG. 11 is a flowchart illustrating a method of adjusting a viewing angle of a display device step by step according to a third embodiment.

As shown in FIG. 11, a viewing angle setting screen is displayed first in operation S1100. At this point, the viewing angle setting screen may be displayed by a user instruction, or may be displayed only if specific conditions are satisfied. Here, the specific condition may include a power-on condition, an input mode switching condition, and a channel switching condition.

At this point, the displayed viewing angle setting screen may be displayed according to two embodiments.

As shown in FIG. 7, the viewing angle setting screen including a first viewing angle setting region 710 for setting a left viewing angle and a second viewing angle setting region 720 for setting a right viewing angle may be displayed. Viewing angle information, which is currently set within an adjustable range, is displayed in the first viewing angle setting region 710 and the second viewing angle setting region 720. Or, a user uses up and down direction keys to increase or decrease the displayed viewing angle.

As shown in FIG. 8, the viewing angle setting screen 800 including the output blocking setting region 810 to set a region that a user wants to block among the left and right regions may be displayed. That is, once a display device is installed, when a first user is positioned at the left of the display device and a second user is positioned at the right of the display device, if the second user does not want to watch the display device, the first user can set to block a viewing angle about the right region in the viewing angle setting screen 800.

The controlling unit 140 determines the left viewing angle and the right viewing angle that will be applied to the display unit 110 according to a user instruction on the menu screen in operation S1110.

That is, the controlling unit 140 determines viewing angles set by the first viewing angle setting region 710 and the second viewing angle setting region 720 as the left viewing angle and the right viewing angle, respectively.

In addition, the controlling unit 140 sets a viewing angle of the side (where the viewing angle blocking is set) with the minimum viewing angle and sets a viewing angle of the other side with the maximum viewing angle. For example, if blocking about the left viewing angle is set in the viewing angle setting screen 800, the controlling unit 140 sets the left viewing angle of the display unit 110 with the minimum viewing angle (for example, 0 degree) and sets the right viewing angle with the maximum viewing angle.

The controlling unit 140 adjusts a viewing angle of the display unit 110 based on the determined left and right viewing angles in operation S1120. That is, the controlling unit 140 outputs an electric control signal corresponding to the determined left viewing angle to the first polarizing element 132 and outputs an electric control signal corresponding to the determined right viewing angle to the second polarizing element 134.

The display unit 110 displays an input image with a viewing angle adjusted by the controlling unit 140 in operation 1030. That is, the polarizing element 120 equipped in the display unit 110 adjusts a polarization degree by using an electric control signal outputted from the controlling unit 140 such that a viewing angle about a screen displayed through the display element 120 can be adjusted.

As mentioned above, in relation to the display device of the third embodiment, a viewing angle of the display device is arbitrarily depending on user needs such the user convenience can be improved and personal display screen can be protected from others. In addition, for other people who do not want to watch a screen, a viewing angle for a specific direction is completely blocked such that a viewer can watch the screen without interference to others.

According to the display device and the method of adjusting a viewing angle thereof, a viewing angle of the display device is adjusted based on viewing environments, such that viewer convenience can be improved and personal display screen can be protected from others.

In addition, a viewing angle of a display device is automatically adjusted according to a position of a viewer, such that eye fatigue of a viewer can be alleviated and an optimized quality image can be provided to a viewer.

Moreover, if important personal data or secrete items need to be displayed, a display screen image is outputted at a front angle such that security about user information can be maintained and personal word processing can be effectively performed.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A display device comprising:

a display unit configured to display, on divided regions of a display screen, a plurality of input images based on a determined viewing angle;

a memory unit configured to store viewing angle information corresponding to a type of input image; and a controlling unit configured to:

determine, using the viewing angle information, a left viewing angle for a left side of the display unit based on detection of a first position of a first viewer that is located at a leftmost position relative to the display unit among multiple viewers of the display unit and an image type of an image displayed at a left region of the display screen, determine, using the viewing angle information, a right viewing angle for a right side of the display unit based on detection of a second position of a second viewer that is located at a rightmost position relative to the display unit among the multiple viewers of the display unit and an image type of an image displayed at a right region of the display screen, the right side of the display unit being opposite of the left side of the display unit and the right viewing angle being different from the left viewing angle, and control the display unit to display, on the divided regions of the display screen, the plurality of input images with the left viewing angle for the left side of the display unit and the right viewing angle for the right side of the display unit, wherein the controlling unit is configured to extract the viewing angle information corresponding to the type of the input image from the memory unit to determine the left viewing angle and the right viewing angle, and control the display unit to display a menu screen for setting the viewing angle corresponding to the type of the input image based on a determination that the viewing angle information corresponding to the type of the input image is not stored in the memory unit.

2. The display device according to claim 1, wherein the display unit comprises:

a display element displaying the plurality of input images; and a polarizing element attached to one side of the display unit and receiving an electric control signal inputted through the controlling unit to perform a polarizing function optically, wherein the controlling unit applies an electric control signal corresponding to the determined viewing angle to the polarizing element.

3. The display device according to claim 2, wherein the polarizing element comprises:

a first polarizing element attached to the left based on the middle of the display element; and a second polarizing element attached to the right based on the middle point of the display element.

4. The display device according to claim 3, wherein:

the controlling unit outputs respectively different electric control signals to the first polarizing element and the second polarizing element based on the determined left and right viewing angles.

5. The display device according to claim 1, comprising a position detecting unit detecting a position of a viewer positioned around the display unit.

6. The display device according to claim 1, wherein the viewing angle information stored in the memory unit is set by a viewer.

7. The display device according to claim 1, wherein the controlling unit determines a viewing angle of the display unit by using viewing angle information corresponding to a type of a currently activated image.

8. The display device according to claim 1, comprising a menu screen generating unit generating a viewing angle setting screen for setting the viewing angle, wherein the controlling unit determines the viewing angle of the display device based on a viewer setting condition set through the viewing angle setting screen.

9. The display device according to claim 8, wherein the viewing angle setting screen comprises a first setting region for setting a left viewing angle of the display unit and a second setting region for setting a right viewing angle of the display unit.

10. A method of adjusting a viewing angle of a display device, the method comprising:

detecting a first position of a first viewer that is located at a leftmost position relative to the display device among multiple viewers of the display device;

detecting a second position of a second viewer that is located at a rightmost position relative to the display device among the multiple viewers of the display device;

detecting image types of a plurality of input images displayed on divided regions of a display screen;

extracting viewing angle information corresponding to the types of the plurality of input images;

determining a left viewing angle for a left side of a display screen based on the detected first position of the first viewer and the viewing angle information;

determining a right viewing angle for a right side of the display screen based on the detected second position of the second viewer and the viewing angle information the right side of the display screen being opposite of the left side of the display screen and the right viewing angle being different from the left viewing angle;

displaying, on the divided regions of the display screen, the plurality of input images with the left viewing angle for the left side of the display screen and the right viewing angle for the right side of the display screen; and displaying a menu screen for setting the viewing angle corresponding to the types of the plurality of input images based on a determination that the viewing angle information corresponding to the types of the plurality of input images is not stored.

11. The method according to claim 10, wherein detecting the first position of the first viewer and detecting the second position of the second viewer comprises obtaining outermost position information corresponding to viewer positions of the first and second viewers by capturing a peripheral image of the display screen.

* * * * *